US007069763B2

(12) United States Patent
Cook et al.

(10) Patent No.: US 7,069,763 B2
(45) Date of Patent: Jul. 4, 2006

(54) CONTAINER END AND FORMING SYSTEMS THEREFOR

(75) Inventors: Stephen T. Cook, Bellbrook, OH (US); Mark F. Broerman, Kettering, OH (US); Dale R. Conley, Bellbrook, OH (US)

(73) Assignee: Dayton Systems Group, Inc., Miamisburg, OH (US)

( * ) Notice: Subject to any disclaimer, the term of this patent is extended or adjusted under 35 U.S.C. 154(b) by 5 days.

(21) Appl. No.: 10/650,630

(22) Filed: Aug. 28, 2003

(65) Prior Publication Data

US 2004/0129709 A1 Jul. 8, 2004

Related U.S. Application Data

(63) Continuation-in-part of application No. PCT/US02/06046, filed on Feb. 27, 2002.

(60) Provisional application No. 60/272,080, filed on Feb. 28, 2001.

(51) Int. Cl.
*B21D 51/38* (2006.01)

(52) U.S. Cl. ..... 72/334; 72/337; 72/339; 413/23; 413/56

(58) Field of Classification Search ..... 72/329, 72/330, 334–337, 339, 404, 379.6; 413/23, 413/56

See application file for complete search history.

(56) References Cited

U.S. PATENT DOCUMENTS

| | | | | |
|---|---|---|---|---|
| 2,070,784 | A * | 2/1937 | Cox | 72/334 |
| 2,384,810 | A * | 9/1945 | Amos et al. | 220/658 |
| 3,844,443 | A * | 10/1974 | Cudzik | 220/296 |
| 5,062,287 | A * | 11/1991 | Brown et al. | 72/336 |
| 5,293,765 | A * | 3/1994 | Nussbaum-Pogacnik | 72/42 |
| 5,572,893 | A * | 11/1996 | Goda et al. | 72/254 |
| 5,822,843 | A * | 10/1998 | Diekhoff et al. | 29/512 |
| 6,015,062 | A * | 1/2000 | Bachmann et al. | 220/295 |
| 6,463,776 | B1 * | 10/2002 | Enoki et al. | 72/46 |
| 6,553,805 | B1 * | 4/2003 | Gruber | 72/336 |

* cited by examiner

*Primary Examiner*—Daniel C. Crane
(74) *Attorney, Agent, or Firm*—Fay, Sharpe, Fagan, Minnich & McKee, LLP

(57) ABSTRACT

A method and apparatus for forming container ends includes tooling which forms dome members for can ends, which dome members include an open neck thereon. Thread lugs are formed as integral spaced apart shaped protrusions from the neck exterior. A system is also disclosed for forming quantities of a specific form of dome members, capable of later attachment to container bodies. A thin metal strip is fed through an array of progressive tooling to form blanks, from which such specific form of dome members are formed. The blanks are produced in the metal strip and connected thereto by multiple carrying strips which allow sufficient mobility of the blanks with respect to the strip to achieve precise alignment with the tooling at different stations in the progression. At the final station, completed dome members are separated from the remaining metal skeleton and moved rapidly out of the system, and the skeleton may be chopped up for recycling. Those specific dome members may be attached to a container body in a subsequent operation.

8 Claims, 13 Drawing Sheets

MATCH TO FIG.5A

VII

VII

60

LIP CURL STATION TO THREAD STATION
AND THREAD STATION TO STACK FORM
STATION PART DETECTION SENSOR

CONTAINER END AND FORMING SYSTEMS THEREFOR

RELATED APPLICATIONS

This application is a continuation-in-part application of International Application PCT/US02/06046 filed 27 Feb. 2002 and designating the US, which claims the benefit of U.S. application Ser. No. 60/272,080 filed 28 Feb. 2001.

BACKGROUND OF THE INVENTION

This invention relates to containers for liquids, particularly beverages, foods, powdered materials, etc. and more particularly to a container end, including a cap and dome, for attachment and use with to various standard types of cans and the like by use of known interlock curl attachment systems. U.S. Pat. No. 6,015,062 issued 18 Jan. 2000 and U.S. Pat. No. 6,082,944 issued 4 Jul. 2000, both assigned to the same assignee as this application, disclose such a container, and cover unique cap/dome container ends, and a system for making them.

The present application relates to an improved system (method and apparatus) for manufacturing container ends and dome parts.

SUMMARY OF THE INVENTION

The principal object of this invention is to provide an improved dome construction to which a lugged cap can be attached, and to provide improved methods of and apparatus for making the improved dome at commercially acceptable speeds. In a principal embodiment the system includes multi-lane progressive tooling which forms the domes from a coil of metal material such as thin gage aluminum. An actual embodiment of that part of the invention is capable of providing in the order of 900 domes per minute from a strip of such material having a width, in the order of nine inches, passed through an array of progressive tooling. Blanks, from which the domes are formed, are produced in the strip of material, connected thereto by multiple thin strips of the material. These strips allow sufficient mobility of the blanks with respect to the strip, the skeleton of which forms a carrier strip, to achieve precise alignment with the tooling sets at different stations in the progression. At certain of these stations thread lugs are formed into neck sections of the domes. At the final station, the completed domes are separated from the skeleton and moved rapidly out of the system, and the skeleton may be chopped up for recycling. Once the strip material from the coil is threaded though the system, the system can operate continuously until the strip is exhausted. A control system, including a programmable logic controller, monitors the passage of the material and parts, and acts to protect the tooling and other parts in the event of jamming or misfeeding of parts. In other aspects of the invention, similar tooling sets can form thread lugs in neck sections formed on a can body.

Other objects and advantages of the invention will be apparent from the following description, the accompanying drawings and the appended claims.

DESCRIPTION OF A PREFERRED EMBODIMENT

Dome & Cap Container End

A container end of the present invention is comprised of two major parts, a dome structure 10, and a cap member (see U.S. Pat. No. 6,015,062) which is in the general form of an inverted cup including an outwardly curled rim depending from the top panel of the cap member and having inwardly extending lugs.

Figure 2:
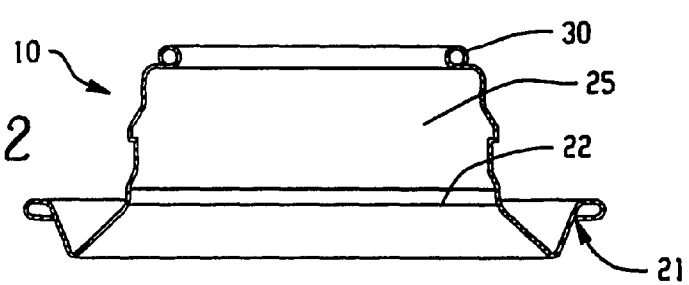
FIG. 2 is a cross-sectional view of the dome.

Referring to FIG. 2, the unique dome 10 of this invention includes a wing-like lower rim 20 capable of being seamed to the upper end or rim of a can body. An optional sealing compound 21 may be added on the underside of rim 20. Rim 20 extends outward from the lower edge of a short generally flat or slightly frusto-conical central dome section 22. Formed on section 22 is a cylindrical neck section 25, of a diameter somewhat less than rim 20 of section 22, and which terminates at its upper edge in an outward curled seal rim 30. The seal rim 30 is intended to contact an elastomeric seal, typically fitted within a cap, and also provides a pour opening for contents of a container to which the end is fitted.

Figure 1:
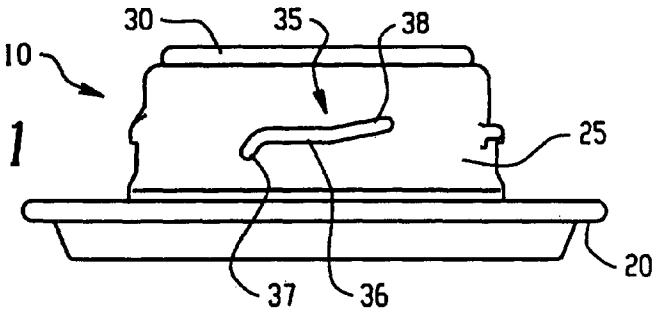
FIG. 1 is a side view of the dome part of a container end constructed according to the invention.
Figure 3:
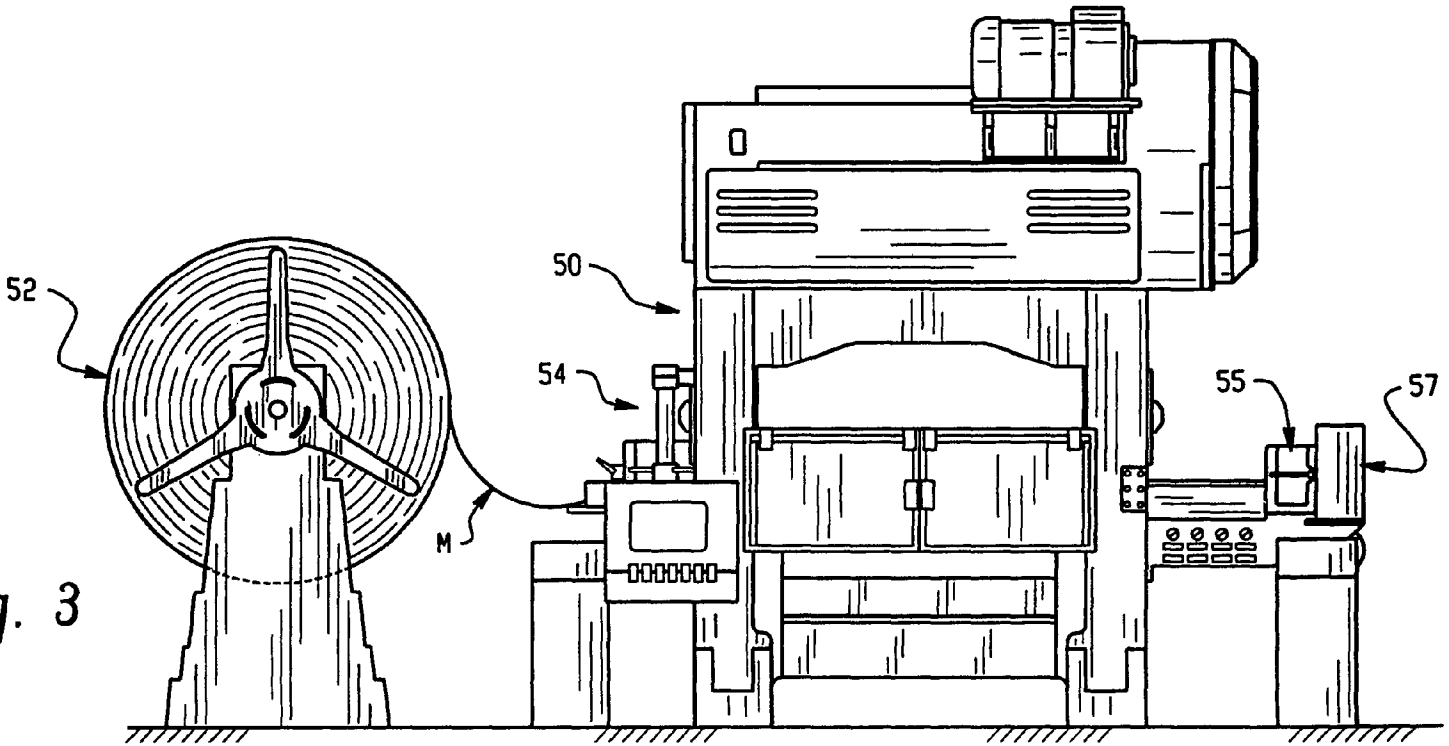
FIG. 3 is a front elevation view of a system for making the dome.
Figure 4:
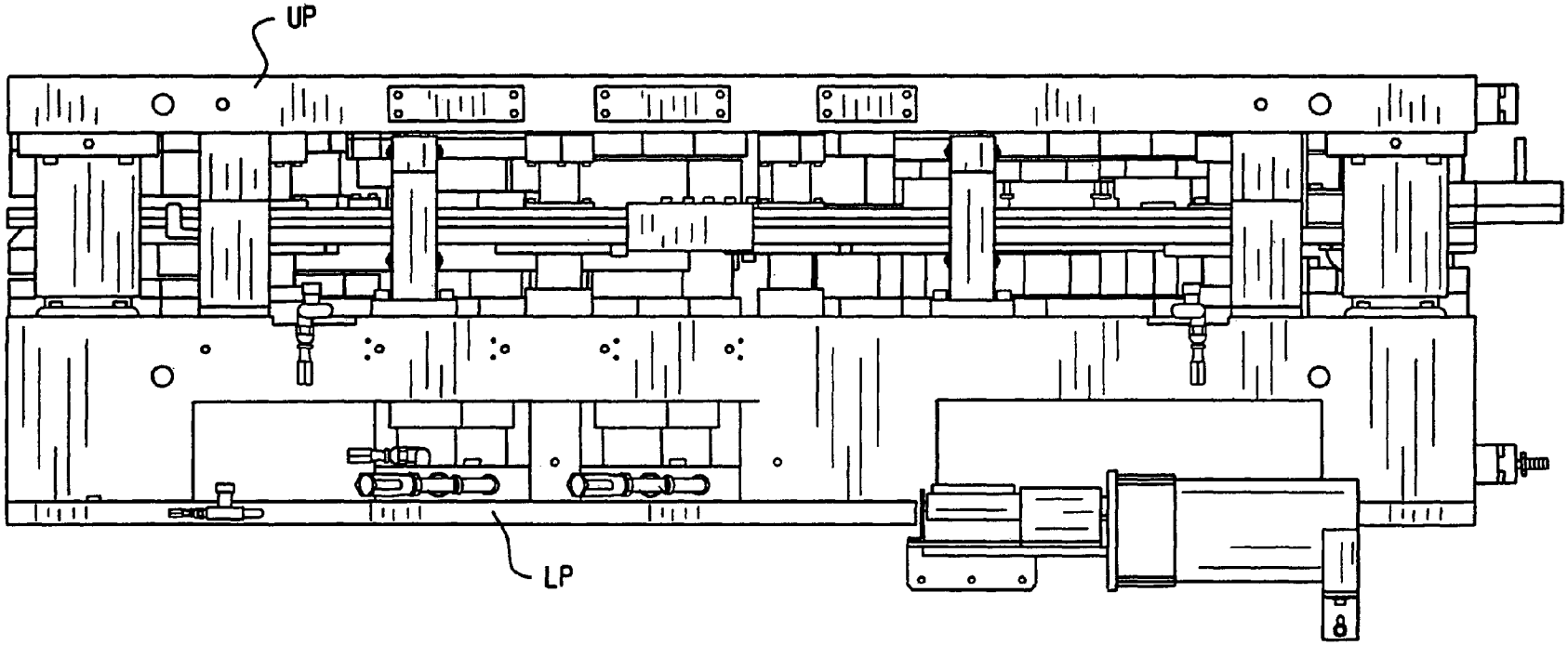
FIG. 4 is a front elevation of the complete (upper and lower) progressive tooling fitted within the dome forming system shown in FIG. 3.
Figure 6:
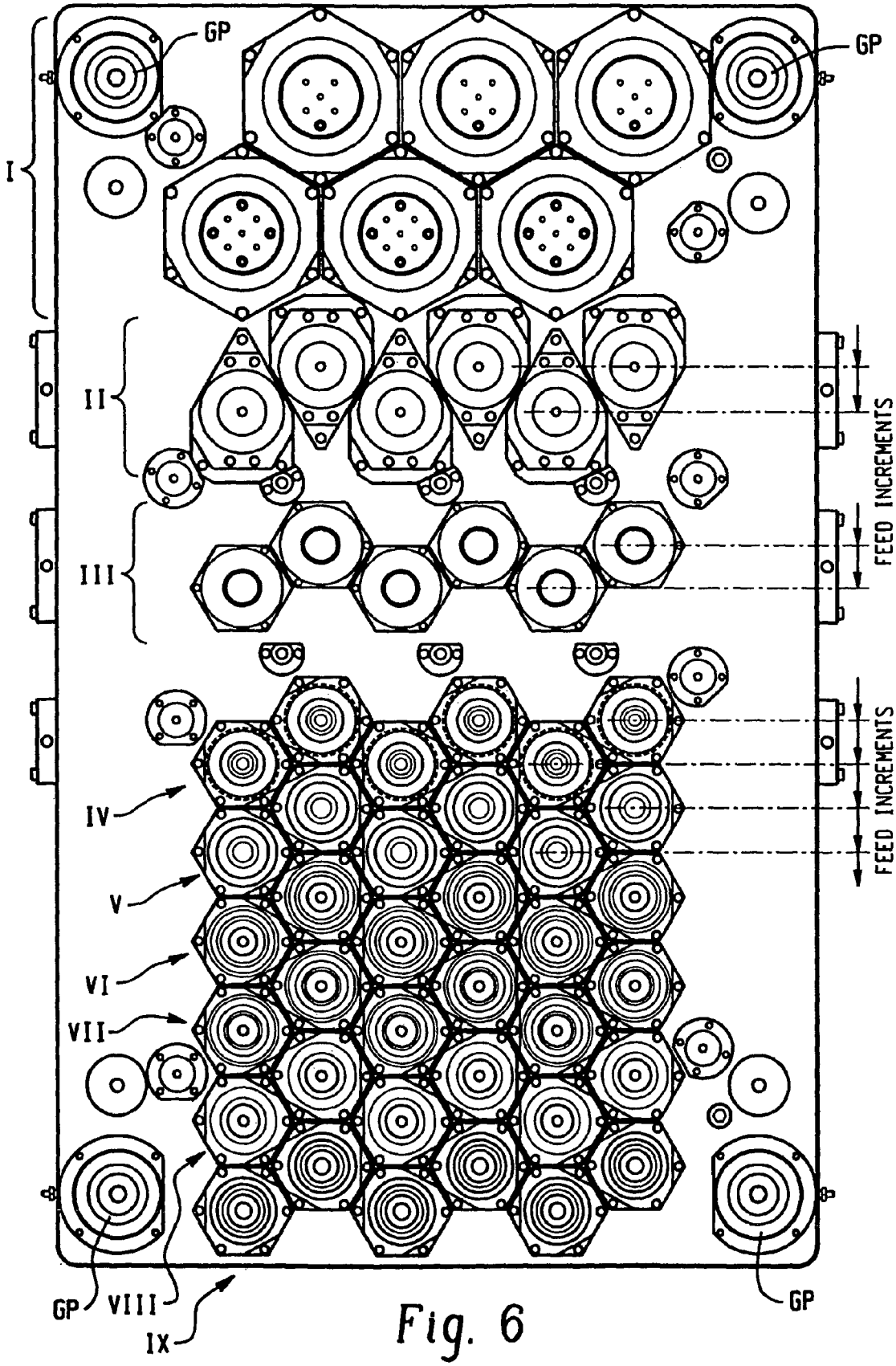
FIG. 6 is a face view taken from the underside of the upper punch tools, showing the tool surface configurations.
Figure 7:
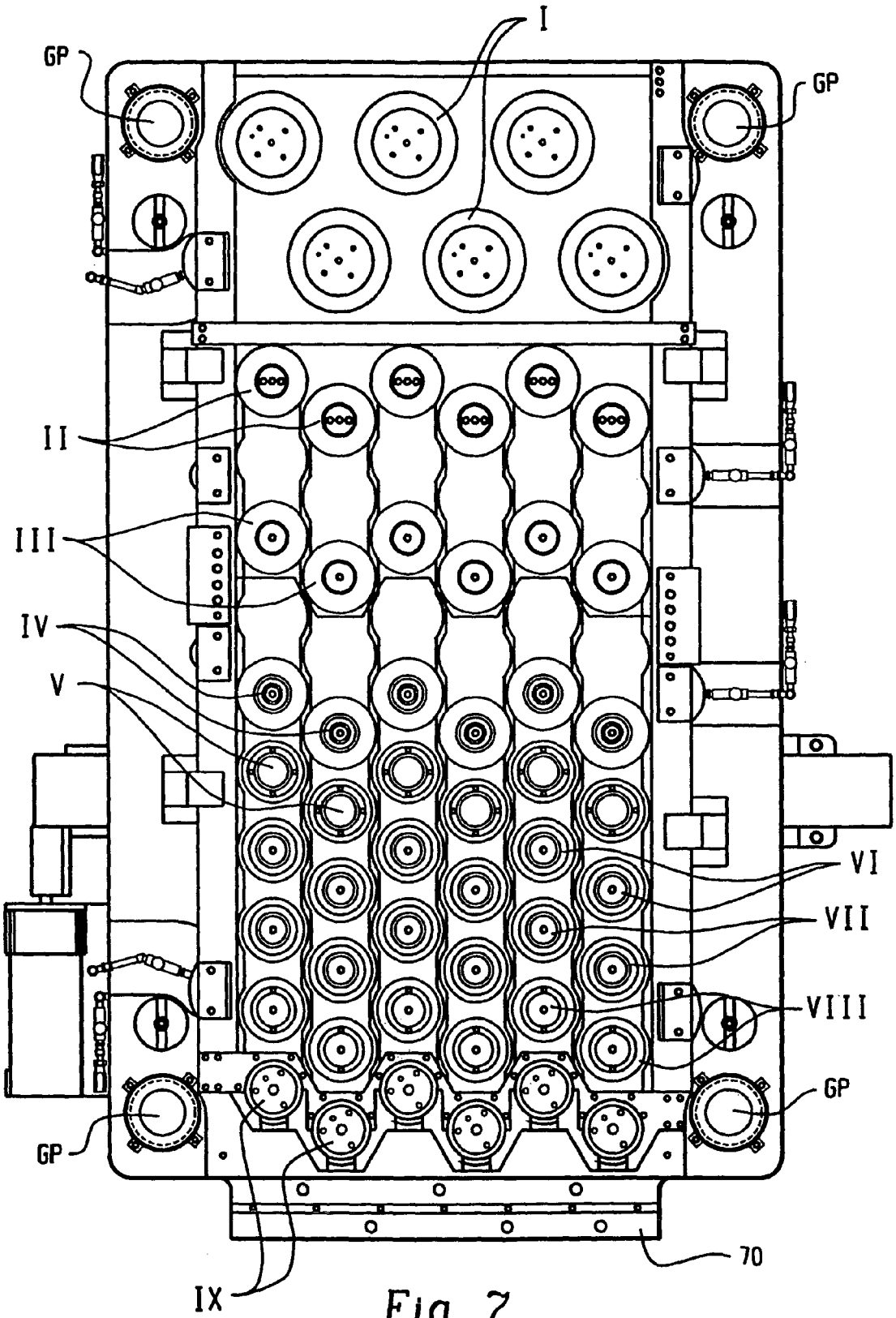
FIG. 7 is a face view taken from the top of the lower die tools, showing those tool surface configurations.
Figures 8A, 8B, 8C, 8D, 8E, 8F, 8G, 8H, 8I, 9B, 9C, 9D, 9E, 9F, 9G, 9H, 9I:
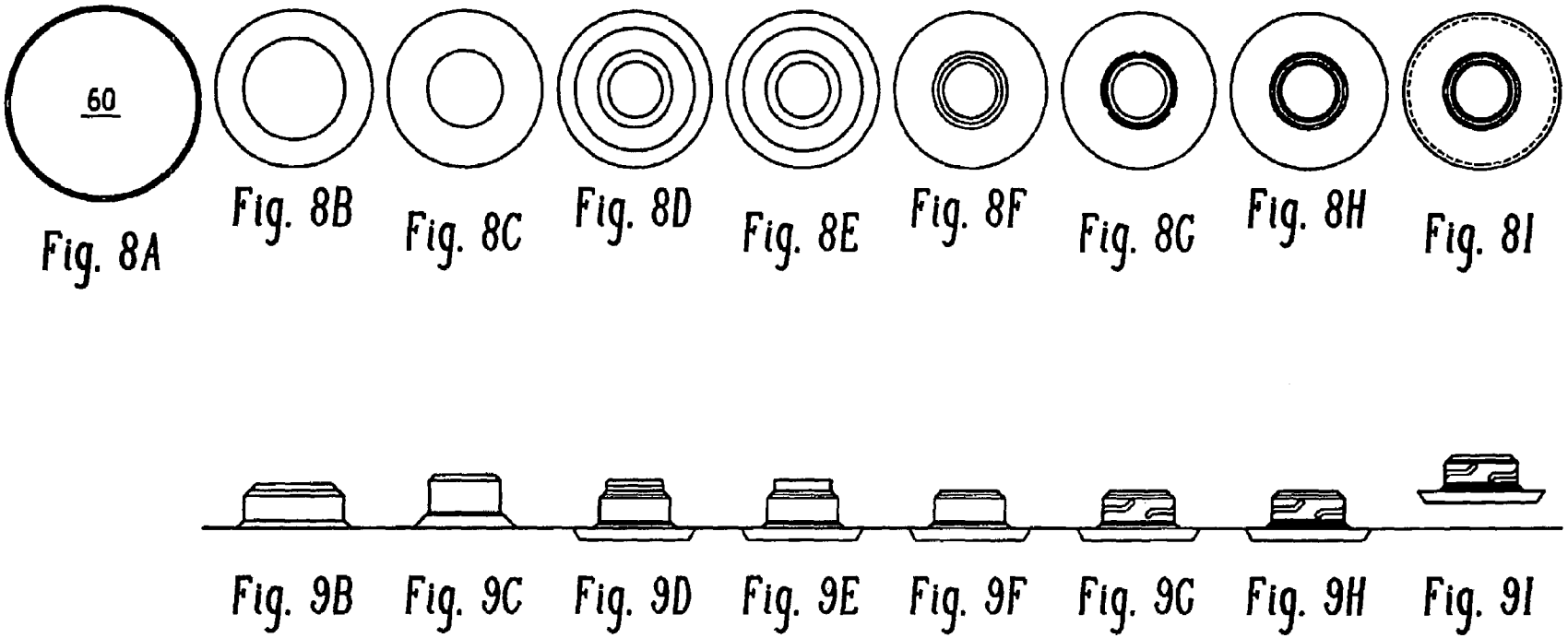
FIGS. 8A–8I and 9B–9I are related top and side views forming an illustration of the basic progressive steps in forming of the dome.
Figure 10:
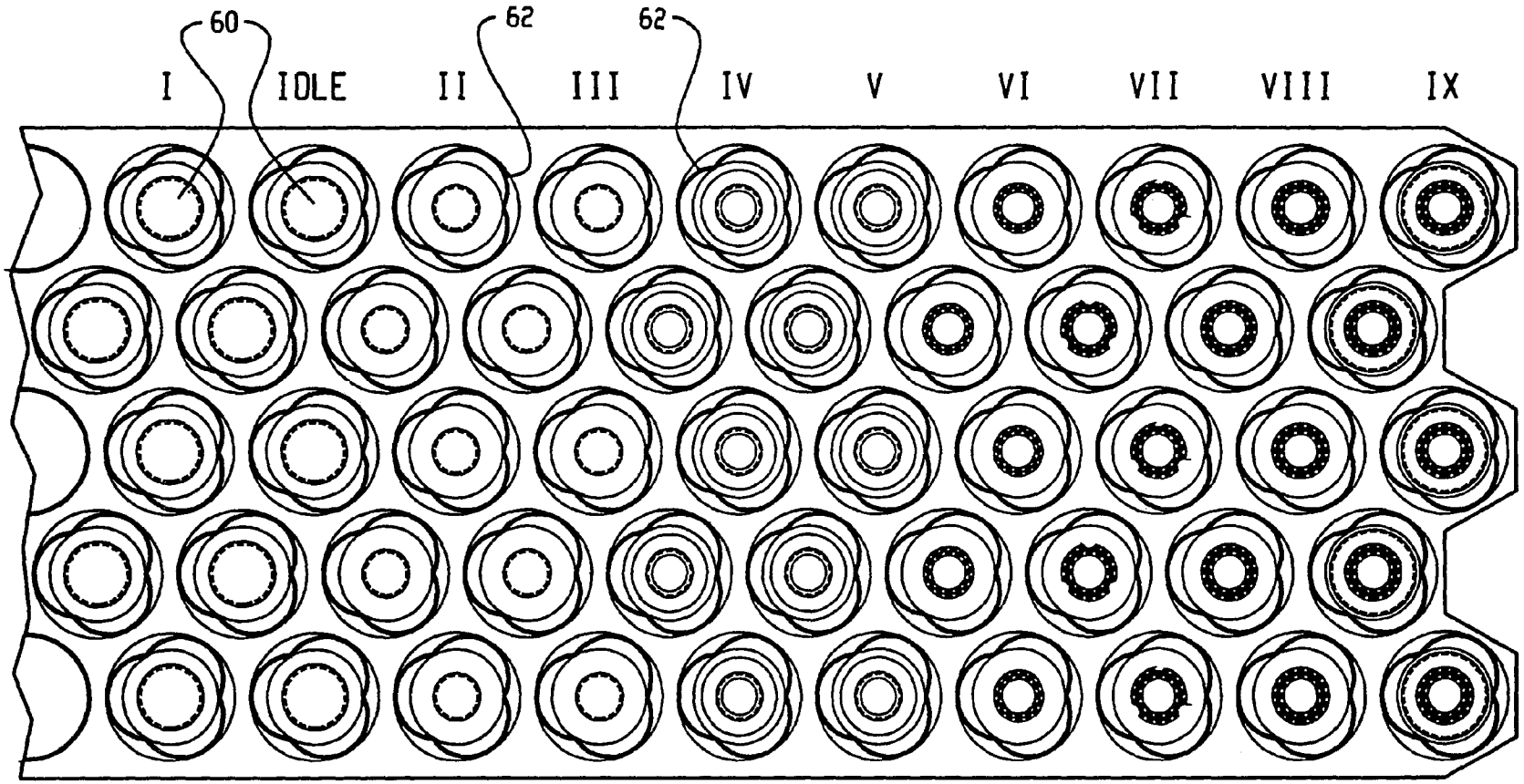
FIG. 10 is a plan view of a section of metal sheet material showing (left to right) the steps in the formation of the domes along six lanes.
Figure 11:
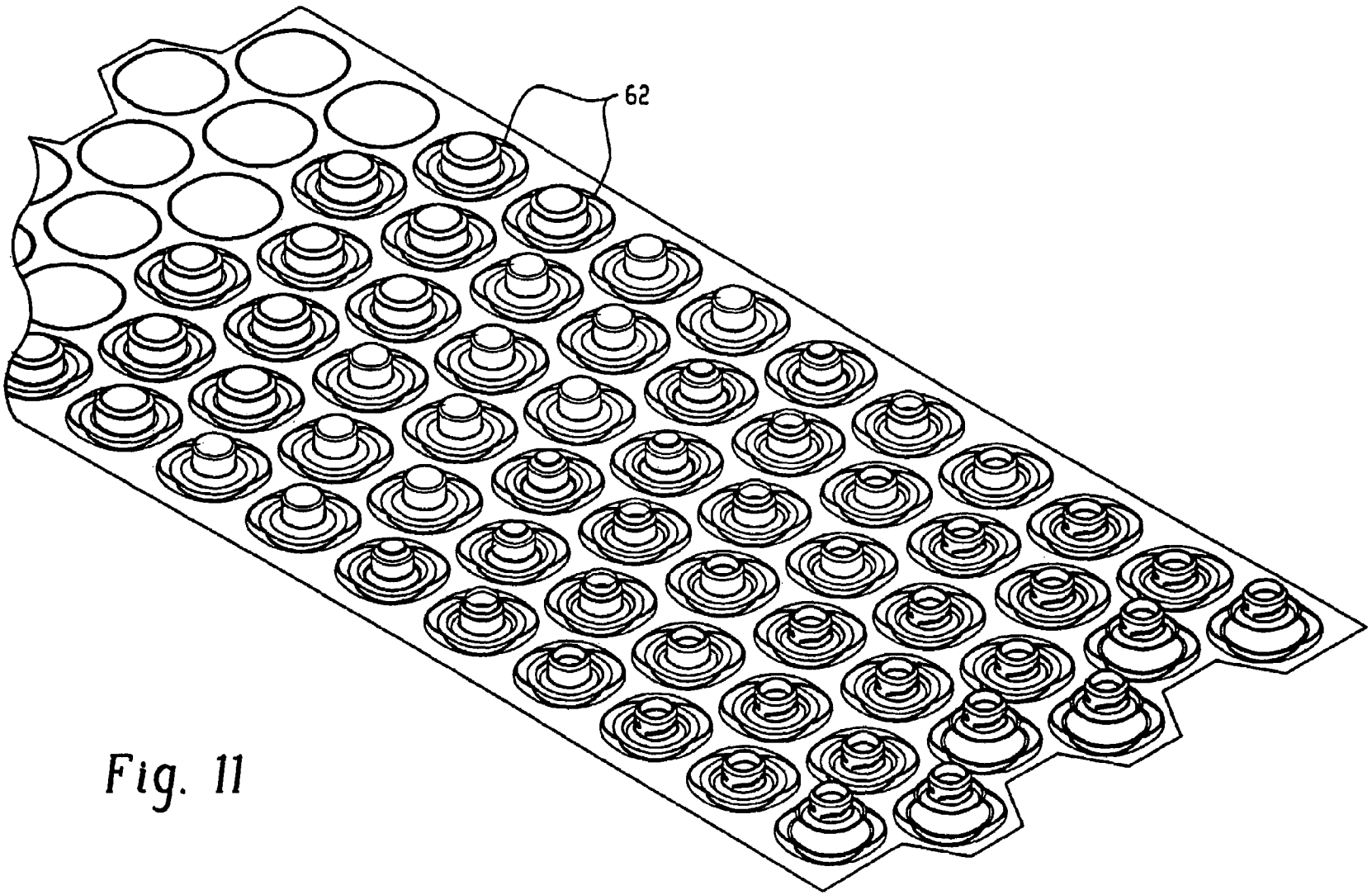
FIG. 11 is a perspective view similar to FIG. 10, illustrating further the connection of the domes to the sheet metal material during successive forming actions.

Formed to extend outward from upper neck section 25 is a set of horizontally elongated, aligned, circumferentially extending spaced apart thread lugs 35 (see FIGS. 1 & 2), shown therein by way of example and not limitation, as four in number, and each including a central part 36 extending at a predetermined spacing from, and generally parallel to and below the curl rim 30, downward angled end parts 37 and upward angled end parts 38 extending for a predetermined length partly around the neck. The tools shown in FIGS. 5, 6 & 7 illustrate formation of three thread lugs on a neck. Thread lugs 35 cooperate with a set of corresponding inwardly extending cap lug members formed in the curled rim of a cap member to hold a cap firmly on a dome structure, as later explained.

When a cap is attached to the upper neck portion, the cooperating thread lugs and cap lug members draw the cap top panel against the curled seal rim 30 of the dome.

The current version of the cap forming tools and system are the subject of an International Application No. PCT/US01/49,392 filed 29 Dec. 2001 and based on U.S. Provisional Patent Application entitled LUGGED CAP FORMING SYSTEM, U.S. Ser. No. 60/257,336 filed 20 Dec. 2000. Details of that system are not specifically related to the present invention, but both it and this present application are improvements of the inventions disclosed in U.S. Pat. Nos. 6,015,062 and 6,082,944, identified above, as is this application.

Dome System

The dome forming tooling disclosed herein is intended for use in a reciprocating high speed press, although other forms of tooling and actuation are within the scope of the invention. In general, referring to FIGS. 3, 4, 5A and 5B, the dome system progressive tooling is embodied in a typical reciprocating press 50 and adjunct equipment. The press tooling includes an upper die plate UP, a lower die plate LP, and guide posts GP which maintain the alignment of punch tools on upper plate UP and corresponding die tools on lower plate LP. These figures represent, in somewhat schematic fashion, the tooling located at different stations within a press.

The material for the domes 10 is supplied from a coil 52 which, by way of example only, is coiled thin aluminum sheet material M. The material should be sufficiently rigid to be fed along its length without buckling, and may be of other metal types, such as coated steel. The material is initially fed into press 50 by a pushing roll feeder 54, through the tooling of the press, and into a pulling roll feeder 55 which takes over control of the material once it is fully threaded into the system. At that time the push feeder can be turned off and pull feeder 55 maintains the cyclic advance of the material M through the system as the domes are formed from the material, separated therefrom, and discharged from the system. The then remaining skeleton of the material M is passed through a scrap cutter 57 and collected for recycling purposes if desired.

Dome Formation

The dome structure 10 is formed in sequential operations at successive tooling stations, as follows.

Broadly, these stations are

I Lance & form basic disk & carry strips from material M;

II Draw basic disk into cup form;

III Draw neck on cup form;

IV Form neck;

V Pierce neck top & iron resultant neck opening;

VI Curl neck lip (pour opening);

VII Thread form, three thread lugs around neck;

VIII Flare internal bottom opening (for stacking);

IX Blank and Curl lower rim of dome.

At each of the nine tooling station (in the illustrated embodiment) there are six identical sets of tools, spaced apart into two offset rows to conserve space, and aligned lengthwise (left to right in FIGS. 4 & 5; top to bottom in FIGS. 6 & 7) into six operative tooling lanes. The number of stations and lanes may vary in other embodiments of the system. As will be noted from FIGS. 6 and 7, certain of the stations occupy more of the length of the entire tooling than do other stations. This is by reason of the need for greater diameter in the tools of station I.

Figure 12:
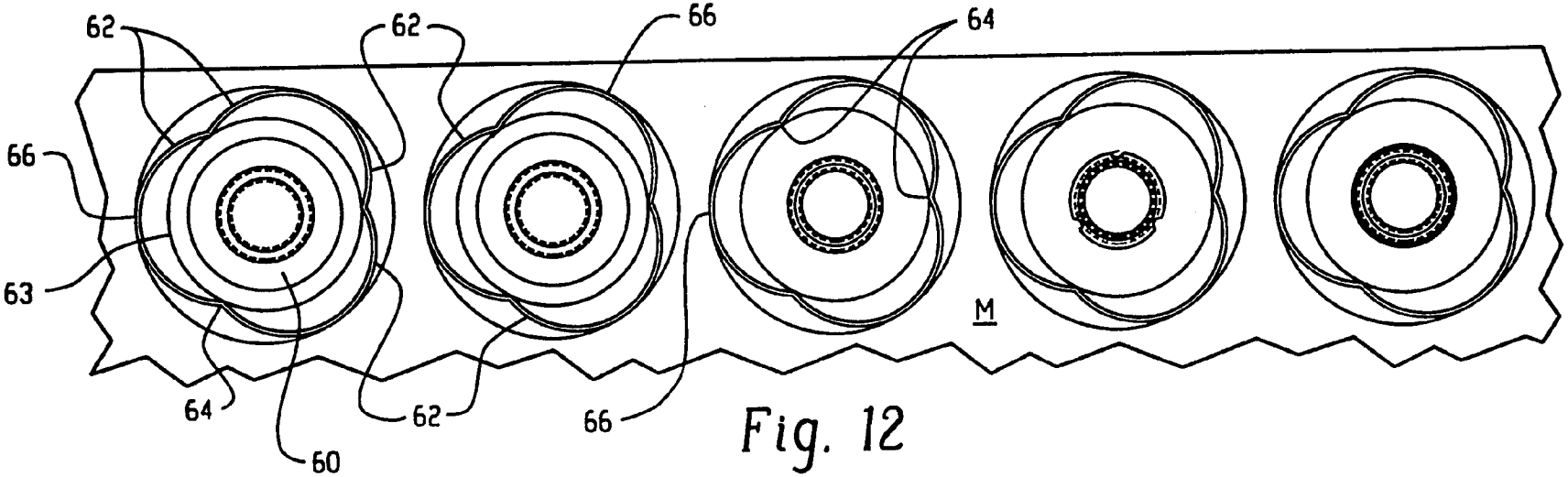
FIGS. 12 and 13 are enlarged views of segments of FIGS. 10 and 11.
Figure 13:
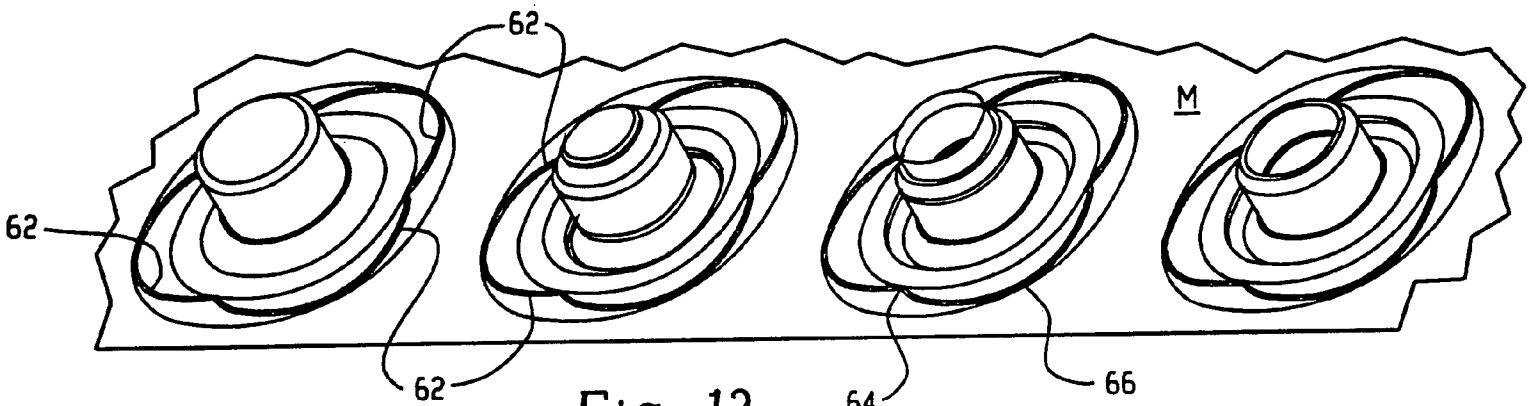

At station I, blanks 60 are cut from material strip M, together with a plurality of carrying strips 62 (six strips in the preferred embodiment) formed to extend from the outer diameter 63 of each blank 60 to the edge of the surrounding material M, i.e. to correspond to the inner diameter of the hole formed in the material M (FIG. 12). This operation leaves each blank 60 integrally attached and supported from material M at the locations 64 (on the blank) and 66 (on the material) by relatively thin and flexible strips 62, as the material is incrementally moved to the successive stations I–IX. The pull feeder 55 draws the strip on material M, with the blanks 60 attached, through the tooling in increment steps equal to the center distance between successive tools in the same lane in stations IV–IX.

The incremental feed distance, and thus the center distance along the lanes between tools, must be sufficiently greater than the diameter of the hole initially formed in the material M to assure that the skeleton of the remaining material is strong enough to resist deformation, such as stretching, during the feeding motion. Because of the relatively large size of the station I tools, it is necessary that extra space be provided to secure alignment of the attached blanks with the centers of the next (station II) tooling. This is provided by having idle positions along the path of the stock (material M) between tooling stations I and II, and between stations II and III (see FIGS. 6 & 7). These idle positions are blank (empty) sections between the tools in those stations, whereby no contact is made between the tools and the material for a space of one feed increment (see FIGS. 5A and 5B). Stated another way, the material must be advanced two feed increments to traverse the center to center distance between tools in stations I, II, III and IV.

Each of the tooling stations includes centering features which cause the work in progress (i.e. the partially formed domes) to become centered during closing of the respective tools. The flexibility of carrying strips 62 allows the parts to achieve such alignment conformity.

Figure 5A:
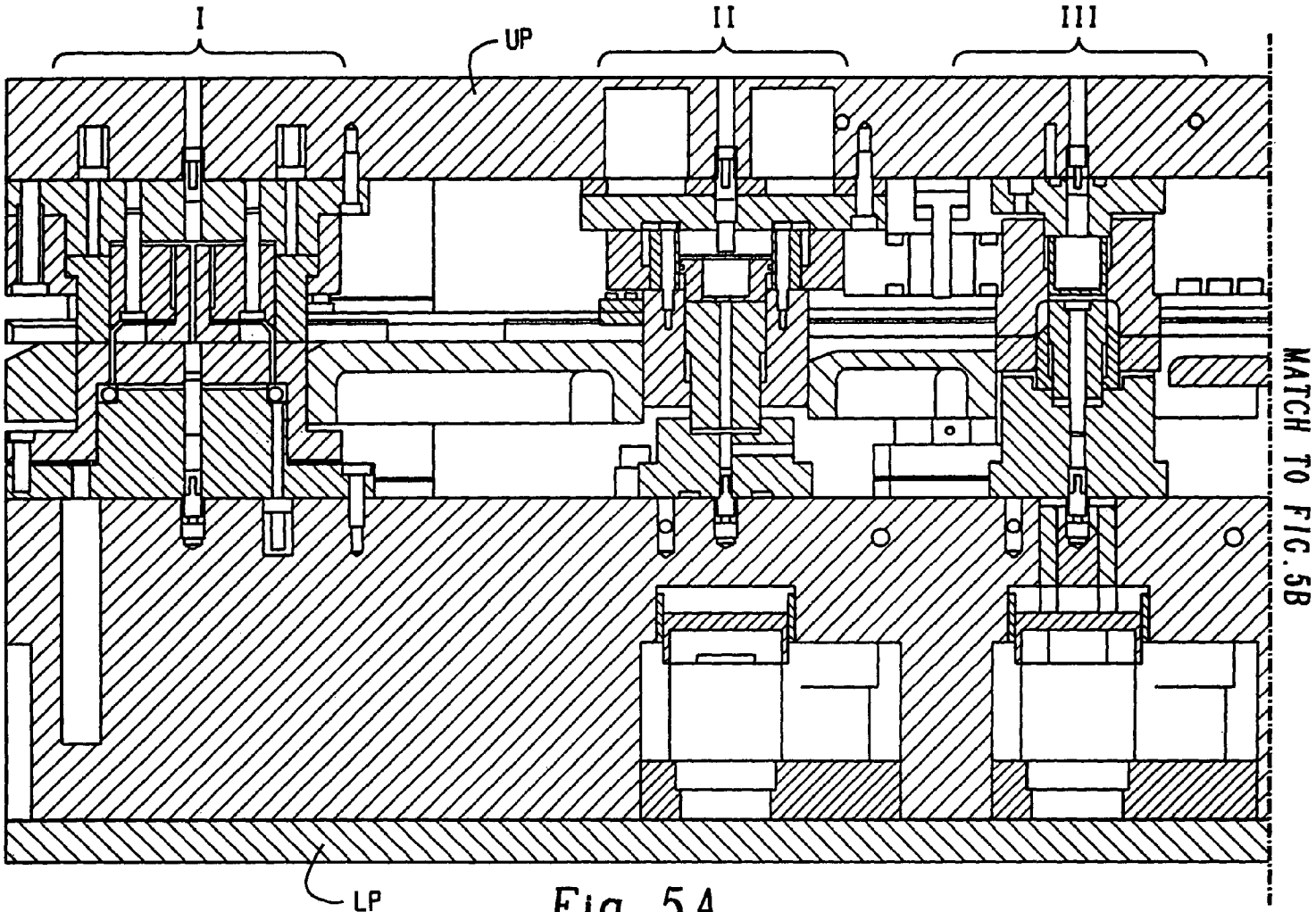
FIGS. 5A and 5B are, together, a cross-section view through one lane of the upper and lower tools (station I to IX) in closed position and FIGS. 5 C & D are enlargements of open and closed station VII tools in FIG. 5B.

Station II tooling operates on the blanks 60 to form them into a cup-like formation (see FIGS. 5A, B & 9B). Then station III tooling (FIG. 5A) acts to draw a neck 25 (FIGS. C & C) upward from the center of the cup, and station IV tooling (FIG. 5B) forms the neck to its desired shape and length, still having an integral top wall; see FIGS. D. & D.

Figure 5B:
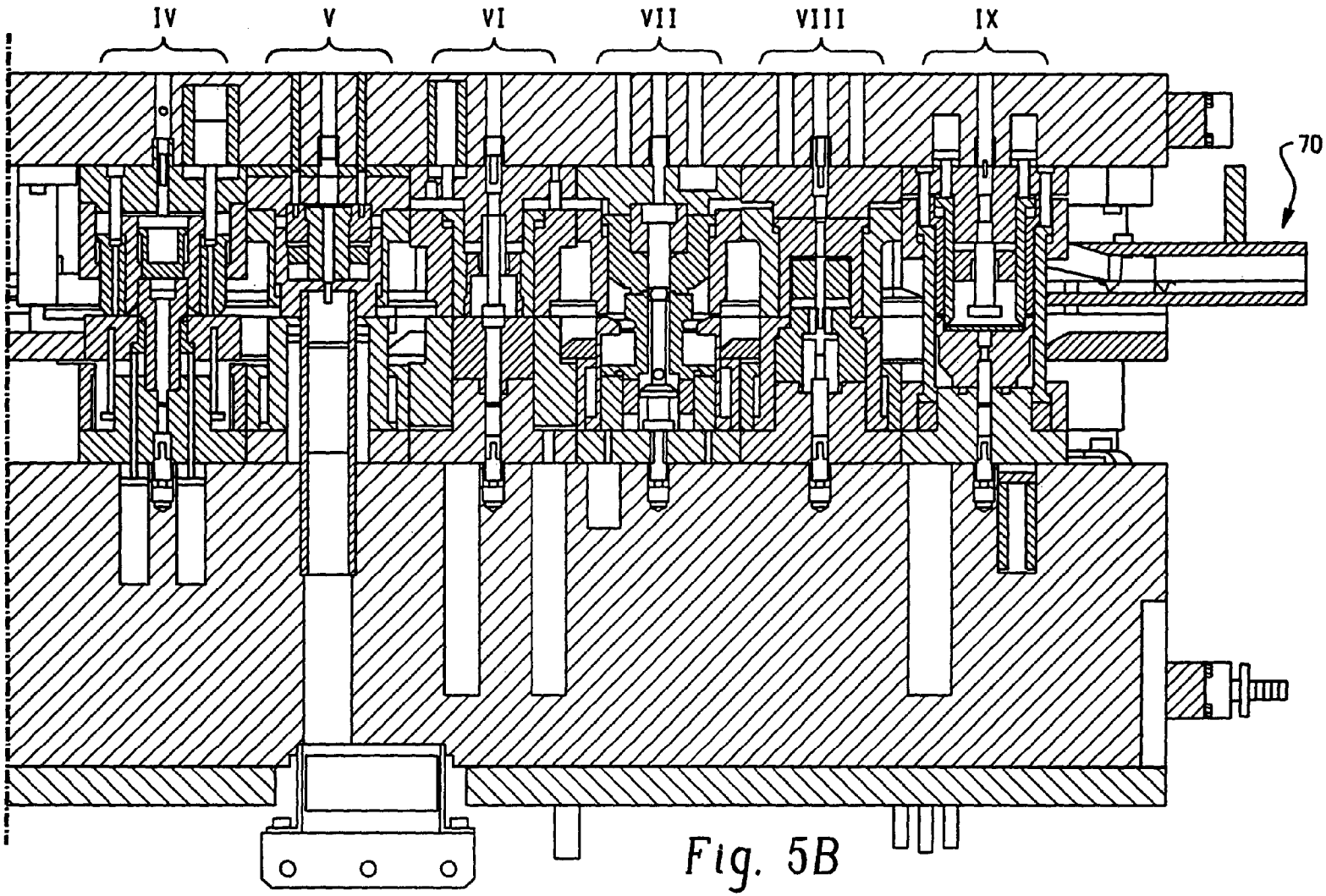
Figure 5C:
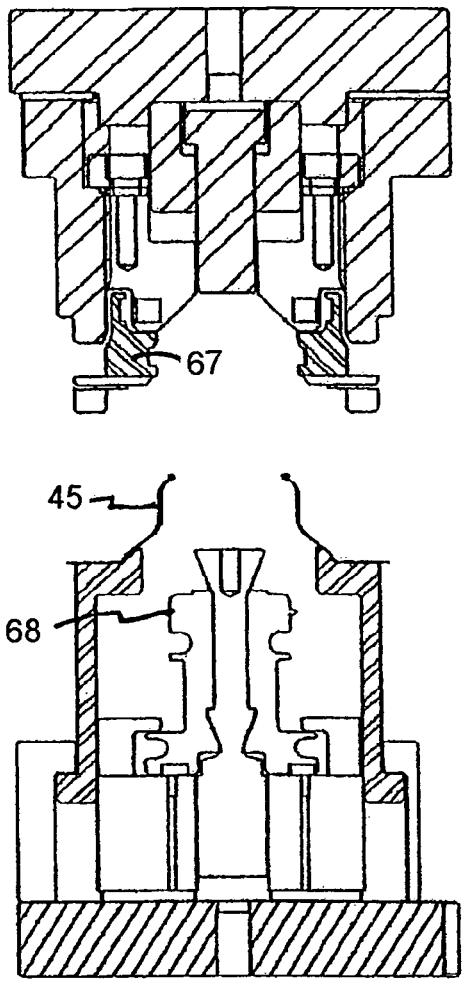

Station V tooling pierces the top of the necks and leaves a rim for the formation, in Section VI tooling, of curls (preferably outward) at the top of the necks; see FIGS. 5B, E & F & E & F.

Figure 5D:
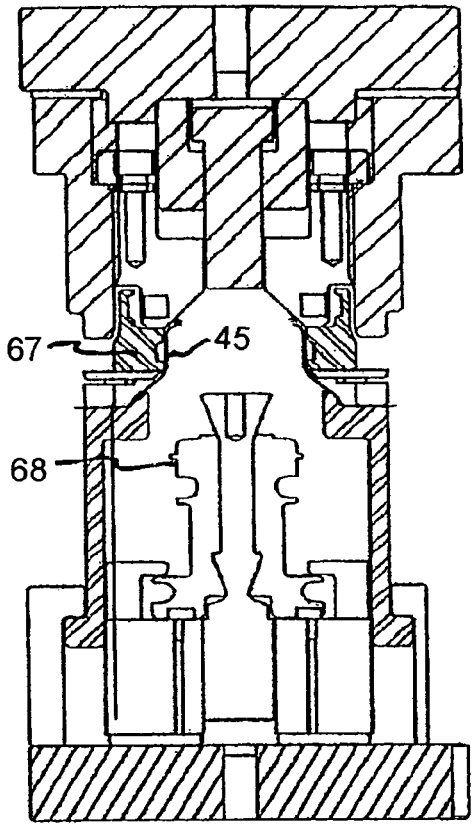

In Section VII tooling the thread lugs 35 are formed on the necks 25 of the dome pieces; see FIGS. 5B, C & D. In FIG. 5B, Section VII the upper and lower tools are shown closed about a neck 25 and in FIG. 5C the tools are open, illustrating the upper thread lug tools radially expanded and aligned above a neck 25. In FIG. 5D the upper thread lug tools (dies 67) embrace the neck 25 and the lower thread lug tools (punches 68) are radially contracted, ready to enter the interior of the neck 25 as the press is closing. When the tools are fully closed, the dies 67 surround the neck, the punches 68 have fully entered the neck and expanded radially outward to press regions of the neck into dies 67, as seen in FIG. 5B. The resulting thread lugs are shown in FIGS. 1, 2, 8G & 9G.

Section VIII tools are simply to reform the central dome section 22.

Figure 14:
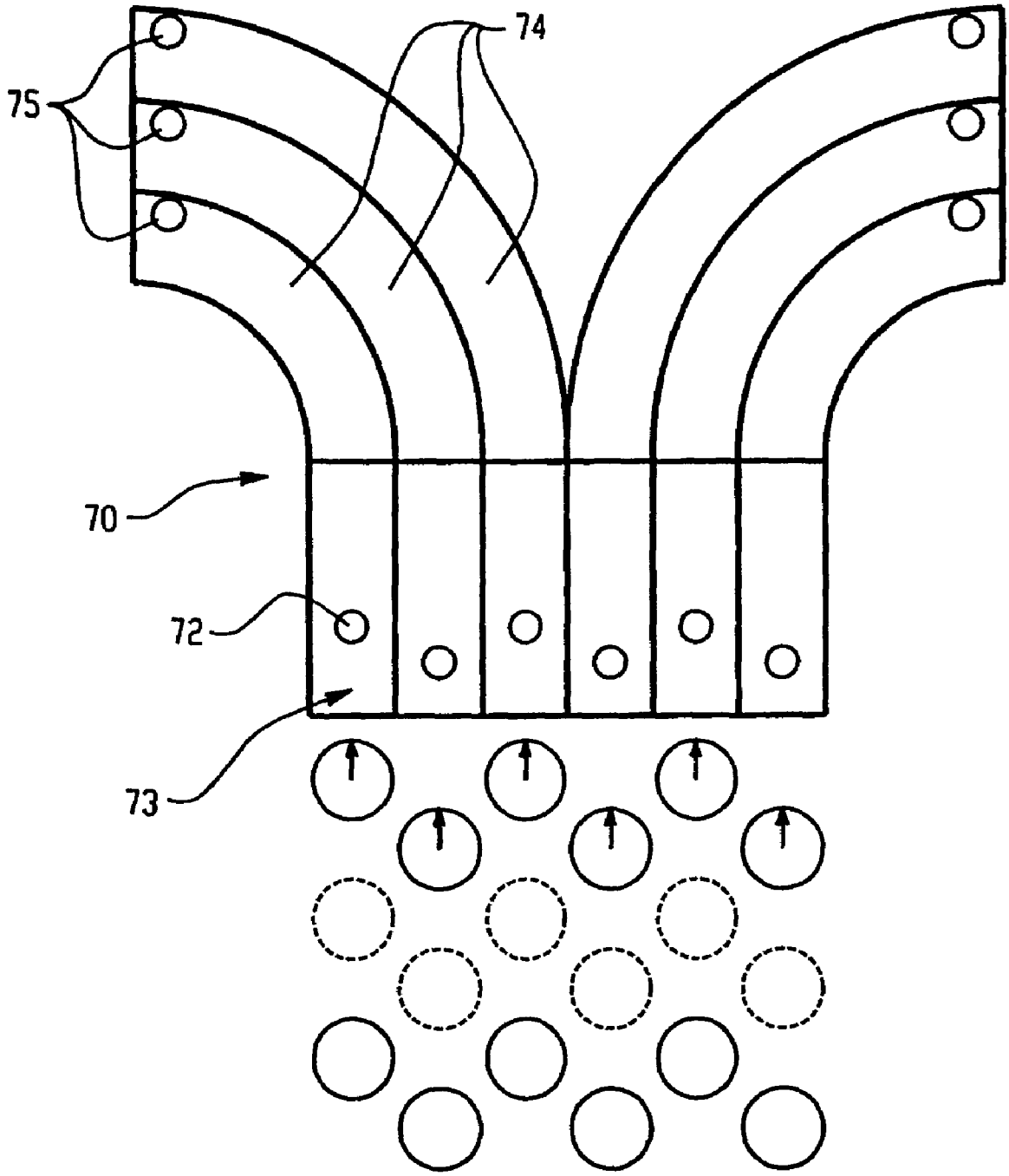
FIG. 14 is a schematic top view of the discharge from the system, at right end of FIG. 3.

Finally, in Section IX tooling the lower rims 20 of the domes are blanked to finished size and in that process the domes are separated from the carry strips 62 and the curls are formed in those rims. As the upper tools in Section IX rise, a vacuum is applied to the domes causing them to rise with the upper tools. When the finished domes reach a predetermined height above the location of the material skeleton, air jets are triggered to push the domes rapidly forward onto a partitioned discharge chute 70 (FIG. 14), passing over discharge sensors 72 in the entrance portions 73 of the chute. Those sensors signal that the domes have left the tooling, and as the domes proceed through the chute exit portions 74 they pass exit sensors 75 which signal the domes have moved out of the discharge chute and left the system.

Figure 15:
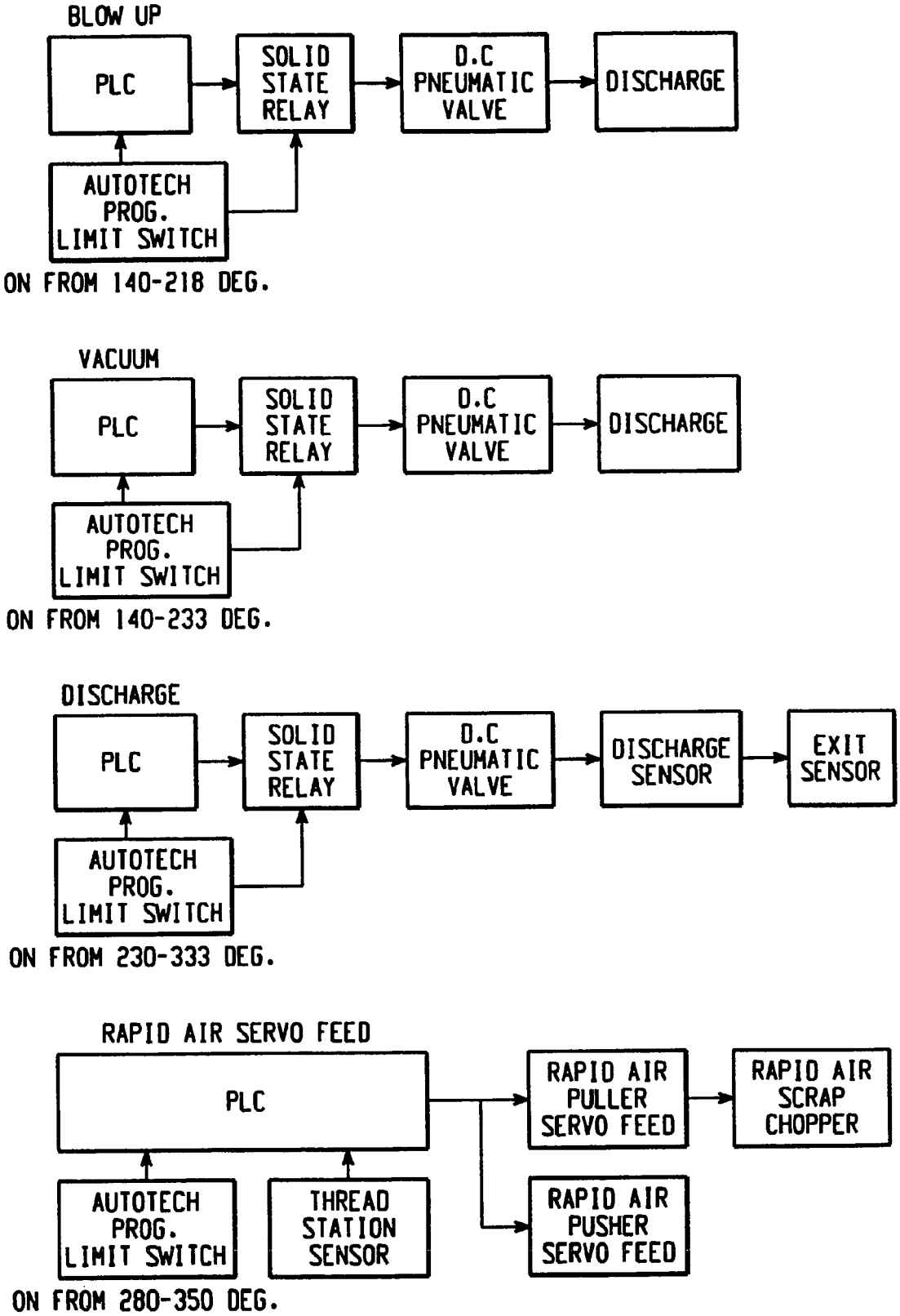
FIG. 15 is a block diagram of the programmable control for the dome forming system.

FIG. 15 is a flow diagram of the electrical/electronics control for the dome making system. A pulse generator is driven by the press crankshaft in typical fashion to generate a train of pulses related to the angular position of the crankshaft as it rotates, and these pulses are directed to the system P.C. (Programmable Logic Controller). Since the diagram is divided into four functions which occur during a press cycle, the controller P.C. is shown in each of the four diagram parts, but in fact one P.C. is employed in the control system. When the automatic press cycling is begun, the Rapid Air roller pusher thread material from the coil through the tooling and into the roller puller unit which takes over the incremental advancement of the material. The press cycling commences and the scrap chopper starts. With each stroke of the press disk-like blanks are blanked from the material of material M. These blanks are flexibly connected to the skeleton of material which functions as a carrier. The integral strips forming these connections about the blanks allow accommodation of the dome parts with each of the tooling sets, wherein precise alignment of the progressively formed parts can be achieved at each tooling station.

Thus, the present invention provides methods and apparatus for making the dome member of a container end. The various punches, dies, and related equipment, associated with the progressive stations disclosed, form a means for accomplishing the various steps described above so as to manufacture the dome members in a mass production environment in a press.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention.

The invention claimed is:

1. A method of forming a container end comprising the steps of:

a) providing a strip of metal;

b) forming blanks in the metal strip wherein each blank is connected to the strip via a plurality of integral carrying strips between the blanks and the strip;

c) forming the blanks into cup form including an open edge;

d) forming a dome shaped region in the open edge of the cup form;

e) forming a neck with a closed end on the cup form above the dome shaped region;

f) piercing the closed end of the neck top to form a neck opening having a lip;

g) forming a curl on the neck lip to define a pour opening;

h) forming multiple thread lug sections spaced circumferentially around said neck and protruding outward from the neck; and i) severing the formed blanks from the strip.

2. The method of claim 1 wherein steps (a) to (f) are performed sequentially at successive stations.

3. The method of claim 2 further comprising the step of advancing the strip from one station to the next between the forming steps.

4. The method of claim 1 wherein the thread lug section forming step (g) includes the steps of reforming portions of the wall of the neck into a plurality of thread lugs extending outwardly from the neck in predetermined alignment.

5. The method of claim 1, comprising the further step of providing multiple sets of successive stations arrayed along parallel paths.

6. In a method of forming a container end, the steps of a) feeding a thin strip of metal along a predetermined path;

b) forming disc shaped blanks from the thin strip of metal;

c) creating integral flexible connections between the blanks and the thin strip of metal, the flexible connections extending from the outer edge of each blank to the edge of the surrounding material from which the blank is formed;

d) forming the blanks into inverted cup forms including a closed end and an open edge attached to the strip of material e) forming a dome region on the closed end of each cup form;

f) forming a neck including a cylindrical wall extending upwardly of the dome region and an opening at the top of the neck defined by a lip;

g) forming an outwardly extending curt on the lip around the opening;

h) forming multiple thread lugs around and protruding outward from the neck by reforming portions of the wall of the neck into a plurality of circumferentially aligned spaced apart lugs projecting outwardly from the neck in predetermined alignment about the neck and at a predetermined spacing from said curl, and continuing with steps a) to g): whereby steps a) to g) are performed sequentially at successive stations and the thin metal strip is advanced from one station to the next between the forming steps.

7. The method of claim 6, in which there are multiple sets of the successive stations arrayed along parallel paths and the steps (a) to (g) are performed on a common metal strip which is advanced along said sets of successive stations.

8. The method of claim 6 wherein the flexible connections are formed as multiple strips connecting the periphery of the blanks to the thin metal strip.

* * * * *